US007682002B2

(12) United States Patent
Brost et al.

(10) Patent No.: US 7,682,002 B2
(45) Date of Patent: Mar. 23, 2010

(54) PRINTER HAVING IMPROVED GAS FLOW DROP DEFLECTION

(75) Inventors: Randolph C. Brost, Albuquerque, NM (US); David J. Nelson, Rochester, NY (US); Bradley A. Phillips, Honeoye Falls, NY (US); Joseph E. Yokajty, Webster, NY (US); Todd R. Griffin, Webster, NY (US); Michael F. Baumer, Dayton, OH (US); Robert J. Simon, Bellbrook, OH (US); Michael S. Hanchak, Dayton, OH (US); James A. Katerberg, Kettering, OH (US); Thomas W. Steiner, Burnaby (CA); Zhanjun Gao, Rochester, NY (US); Jinquan Xu, Rochester, NY (US); John Charles Brazas, Jr., Hilton, NY (US); David Louis Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 437 days.

(21) Appl. No.: 11/744,998

(22) Filed: May 7, 2007

(65) Prior Publication Data

US 2008/0278548 A1 Nov. 13, 2008

(51) Int. Cl.
*B41J 2/09* (2006.01)

(52) U.S. Cl. ..... 347/77

(58) Field of Classification Search ..... 347/77, 347/73–76, 78–83

See application file for complete search history.

(56) References Cited

U.S. PATENT DOCUMENTS

| | | | | |
|---|---|---|---|---|
| 3,596,275 | A | 7/1971 | Sweet | |
| 4,068,241 | A | 1/1978 | Yamada | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,536,883 | B2 * | 3/2003 | Hawkins et al. | 347/77 |
| 6,554,389 | B1 | 4/2003 | Hawkins et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,746,108 | B1 * | 6/2004 | Jeanmaire | 347/82 |

(Continued)

FOREIGN PATENT DOCUMENTS

| | | |
|---|---|---|
| EP | 1 221 373 | 7/2002 |

(Continued)

*Primary Examiner*—K. Feggins
(74) *Attorney, Agent, or Firm*—William R. Zimmerli

(57) ABSTRACT

A drop generator operable to selectively form a drop having a first size and a drop having a second size from liquid emitted through a nozzle associated with the drop generator. The drop having the first size and the drop having the second size travel along a drop trajectory with the first size being larger than the second size when compared to each other. Each of the drops has a drop velocity. A gas flow deflection system includes a gas flow that is directed at a deflection zone that comprises at least a portion of the drop trajectory. The gas flow in the deflection zone includes a velocity vector having a parallel velocity component and a perpendicular velocity component with the parallel velocity component and the perpendicular velocity component being defined relative to the drop trajectory.

30 Claims, 10 Drawing Sheets

U.S. PATENT DOCUMENTS

| | | | | |
|---|---|---|---|---|
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 6,863,385 | B2 * | 3/2005 | Jeanmarie et al. | 347/77 |
| 2004/0095441 | A1 | 5/2004 | Jeanmaire | |

FOREIGN PATENT DOCUMENTS

| | | |
|---|---|---|
| EP | 1 228 873 | 8/2002 |
| EP | 1 308 278 | 5/2003 |

* cited by examiner

PRINTER HAVING IMPROVED GAS FLOW DROP DEFLECTION

FIELD OF THE INVENTION

This invention relates generally to the field of digitally controlled printing devices, and in particular to continuous ink jet printers in which a liquid ink stream breaks into drops, at least some of which are selectively deflected.

BACKGROUND OF THE INVENTION

Printing devices that deflect drops using a gas flow are known. U.S. Pat. No. 4,068,241 to Yamada, issued Jan. 10, 1978, entitled "Ink-jet recording device with alternate small and large drops," describes a printing device that uses a gas flow perpendicular to the drop trajectory to separate large drops and small drops formed by a printhead. The small drops are deflected more by the gas flow than the large drops. The large drops are collected by a catcher while the small drops were deflected past the catcher and allowed to strike a recording medium.

However, it has been determined that while the gas flow does deflect the large and small drops by different amounts, the gas flow past a stream of drops produces drop-drop interactions that affect drop deflection. For example, drop deflection can be affected by the size of and spacing from the previous drop in the drop stream. As a result, the placement of drops on the recording medium can be adversely affected. Additionally, the relative deflection between large drops and small drops can be affected by the preceding drops reducing the ability to catch drops of one size while allowing drops of another size to travel to strike the recording medium.

As such, there is a need for an improved gas flow drop deflection device and a printing apparatus including the same.

SUMMARY OF THE INVENTION

According to one aspect of the invention, a printing apparatus includes a drop generator operable to selectively form a drop having a first size and a drop having a second size from liquid emitted through a nozzle associated with the drop generator. The drop having the first size and the drop having the second size travel along a drop trajectory with the first size being larger than the second size when compared to each other. Each of the drops has a drop velocity. A gas flow deflection system includes a gas flow that is directed at a deflection zone that comprises at least a portion of the drop trajectory. The gas flow in the deflection zone includes a velocity vector having a parallel velocity component and a perpendicular velocity component with the parallel velocity component and the perpendicular velocity component being defined relative to the drop trajectory. The parallel velocity component is greater than 0.25 times the drop velocity, and the perpendicular velocity component is sufficient to deflect the drop having the first size and the drop having the second size to a first size drop trajectory and a second size drop trajectory. A catcher is positioned relative to one of the first drop size trajectory and the second drop size trajectory such that the drops traveling along one of the first drop size trajectory and the second drop size trajectory are intercepted by the catcher while drops traveling along the other of the first drop size trajectory and the second drop size trajectory are not intercepted by the catcher.

According to another aspect of the invention, a method of printing includes selectively forming a drop having a first size and a drop having a second size from liquid emitted through a nozzle associated with a drop generator, the drop having the first size and the drop having the second size traveling along a drop trajectory, the first size being larger than the second size when compared to each other, each of the drops having a drop velocity; directing a gas flow toward a deflection zone that comprises at least a portion of the drop trajectory using a gas flow deflection system, the gas flow in the deflection zone including a velocity vector having a parallel velocity component and a perpendicular velocity component, the parallel velocity component and the perpendicular velocity component being defined relative to the drop trajectory, the parallel velocity component being greater than 0.25 times the drop velocity, and the perpendicular velocity component being sufficient to deflect the drop having the first size and the drop having the second size to a first size drop trajectory and a second size drop trajectory; and intercepting the drops traveling along one of the first drop size trajectory and the second drop size trajectory using a catcher positioned relative to one of the first drop size trajectory and the second drop size trajectory while not intercepting drops traveling along the other of the first drop size trajectory and the second drop size trajectory.

According to another aspect of the invention, a printhead includes a drop generator configured to selectively form a large volume drop and a small volume drop from liquid emitted through a nozzle associated with the drop generator, the large volume drop and the small volume drop traveling along an initial drop trajectory. A gas flow deflection system includes a gas flow provided by a positive pressure source through a first gas flow duct. The gas flow is directed at a non-perpendicular non-parallel angle relative to the initial drop trajectory such that the small volume drop is deflected from the initial drop trajectory by the gas flow and begins traveling along a deflected small volume drop trajectory. A catcher is positioned relative to the deflected small volume drop trajectory such that the small volume drop is intercepted by the catcher. A portion of the gas flow provided by the first gas flow duct is removed from the printhead through a second gas flow duct located between the catcher and the drop generator.

According to another aspect of the invention, a method of printing includes selectively forming a large volume drop and a small volume drop from liquid emitted through a nozzle using a drop generator, the large volume drop and the small volume drop traveling along an initial drop trajectory; providing a gas flow created by a positive pressure source through a first gas flow duct of a gas flow deflection system; directing the gas flow at a non-perpendicular non-parallel angle relative to the initial drop trajectory to deflect the small volume drop from the initial drop trajectory to a deflected small volume drop trajectory; intercepting the small volume drop using a catcher positioned relative to the deflected small volume drop trajectory; and removing a portion of the gas flow provided by the first gas flow duct from the printhead through a second gas flow duct located between the catcher and the drop generator.

According to another aspect of the invention, a printhead includes a drop generator configured to selectively form a large volume drop and a small volume drop from liquid emitted through a nozzle associated with the drop generator, the large volume drop and the small volume drop traveling along an initial drop trajectory. A gas flow deflection system includes a gas flow provided by a positive pressure source through a first gas flow duct. The gas flow is directed at a non-perpendicular non-parallel angle relative to the initial drop trajectory such that the small volume drop is deflected from the initial drop trajectory by the gas flow and begins traveling along a deflected small volume drop trajectory. A catcher is positioned relative to the initial drop trajectory such that the large volume drop is intercepted by the catcher. The first gas flow duct is located between the catcher and the drop generator.

According to another aspect of the invention, a method of printing includes selectively forming a large volume drop and a small volume drop from liquid emitted through a nozzle using a drop generator, the large volume drop and the small volume drop traveling along an initial drop trajectory; providing a gas flow created by a positive pressure source through a first gas flow duct of a gas flow deflection system; directing the gas flow at a non-perpendicular non-parallel angle relative to the initial drop trajectory to deflect the small volume drop from the initial drop trajectory to a deflected small volume drop trajectory; and intercepting the large volume drop using a catcher positioned relative to the initial drop trajectory, the first gas flow duct being located between the catcher and the drop generator.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. In the example embodiments described below like reference signs have been used when possible to describe like features.

Figure 1:
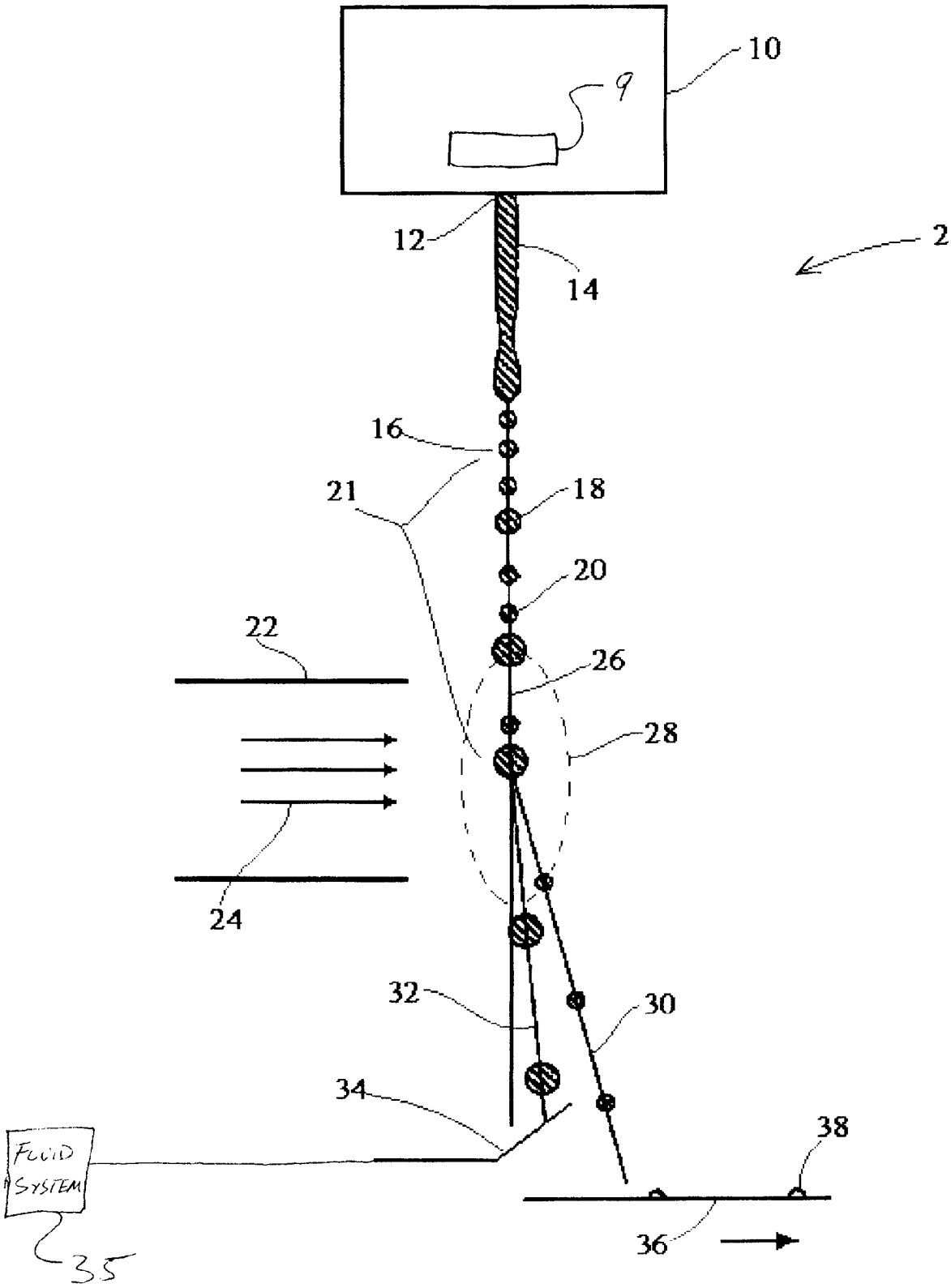
FIG. 1 is a schematic view of a prior art printing apparatus.

FIG. 1 shows a prior art printing apparatus. Printhead 2 includes a drop generator 10 with at least one nozzle 12 from which liquid, for example, ink, is emitted under pressure to form filaments of liquid 14. A drop stimulation or forming device 9, for example, a heater or a piezoelectric actuator, associated with the drop generator is capable of perturbing the filament of liquid to induce portions of the filament to breakoff from the main filament to form drops 16. By selective activation of the drop forming device selective portions of the filament can break off and coalesce into drops 16. Printheads like printhead 2 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, the drops are created in a plurality of sizes, for example, in the form of large drops 18, a first size, and small drops 20, a second size. The ratio of the mass of the large drops 18 to the mass of the small drops 20 is typically approximately an integer between 2 and 10. A drop stream 21 including these drops follows a drop trajectory 26.

A gas flow deflection system includes a duct 22 that is used to direct a flow of gas, for example, air, 24 past a portion of the drop trajectory 26. This portion of the drop trajectory is called the deflection zone 28. As the flow of air 24 strikes the drops in the deflection zone 28 it alters the drop trajectories. As the drop trajectories pass out of the deflection zone they are traveling at an angle, called a deflection angle, relative to the undeflected drop trajectory.

Small drops 20 are more affected by the flow of air than are large drops 18 so that the small drop trajectory 30 diverges from the large drop trajectory 32. That is, the deflection angle for small drops is larger than for large drops. The flow of air 24 should provide sufficient drop deflection and therefore sufficient divergence of the small and large drop trajectories so that the catcher can be positioned so that it intercepts one of the two trajectories and not the other. In this way drops following the one trajectory will be caught by the catcher, allowing the ink to be recycled, while drops following the second trajectory will miss the catcher and can strike the print media 36.

In FIG. 1, a catcher 34 is positioned to intercept the large drop trajectory 32, so that the large drops are caught and the ink returned to a fluid system 35. The small drops 20 are deflected sufficiently to avoid contact with the catcher 34. They strike the print media 36 to forms dots 38 on the print media. As the small drops are printed, this is called small drop print mode. In an alternate embodiment of the prior art, the catcher can be positioned so that it intercepts the small drop trajectory but not the large drop trajectory. In this case, the large drops are the drops that print. This is referred to as large drop print mode.

It has been found experimentally that while small drops are deflected by the lateral airflow more than large drops, not all small drops follow the same trajectory. Similarly, not all large drops follow the same trajectory. This occurs even when the deflecting airflow is a stable, non-turbulent airflow. In particular, it has been seen that the deflection of a drop depends in part on whether it is preceded by a large or small drop.

Figure 2:
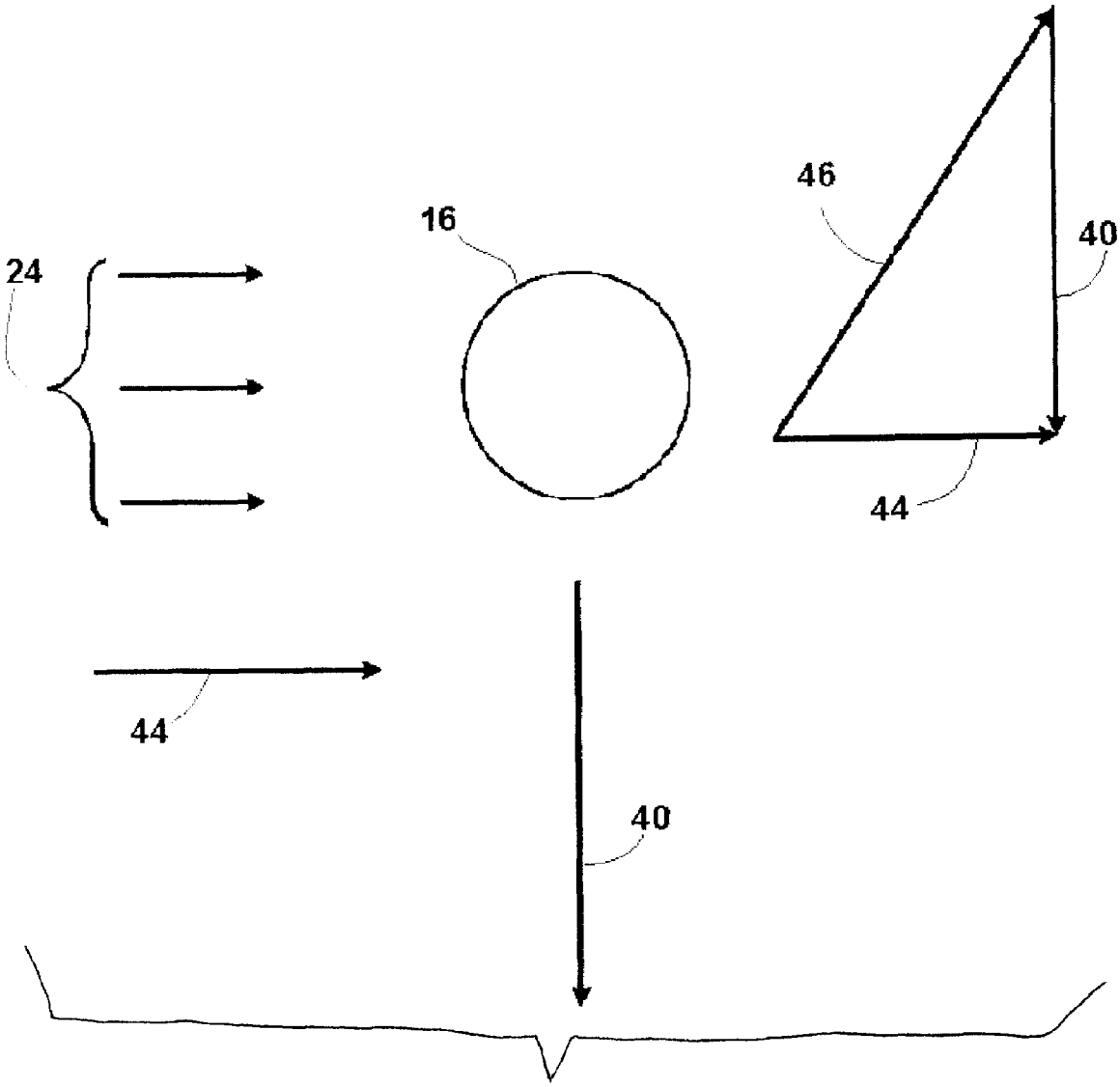
FIG. 2 is a free body diagram of gas flow—drop interaction according to the prior art.

FIG. 2 shows a free body diagram of an individual drop 16 encountering a flow of gas 24, for example, air, provided by the prior art printing apparatus or system. The drop is moving downward with a drop velocity vector 40. The flow of air has an air velocity vector 44. This air velocity vector 44 provides sufficient lateral force of the drop to produce the desired change in drop trajectory. The relative velocity 46 of the air to the drop is given by the vector difference of the air velocity vector 44 and drop velocity vector 40. The force acting on the drop 16 by the air is directed along this relative velocity vector 46 and varies approximately as the square of the relative velocity. From this diagram, it is clear that although the air flow is directed perpendicular to the drop trajectory the relative velocity and the resultant force on the drop are not perpendicular to the drop trajectory. As a result, the drop is not only deflected laterally by the air flow, but its downward velocity is also reduced by the air flow.

If all drops encounter the same deflecting air flow, the determination that the air flow reduces the component of velocity parallel to the drop trajectory causes no problems as the drop deflection and the time of flight induced dot placement shift on the paper are consistent and can be taken into account. However, the variation in drop seen is not simply the result of the drops being slowed down by the relative velocity vector having a component parallel to the drop trajectory.

The observed drop deflection variation seems to be the result of the wake produced by a drop as the air passes it. The wake produced by a drop is aligned with the relative velocity vector. With the drop wakes aligned with the relative velocity vector, the wake produced by the flow of air past a first drop can alter the flow of air past the drop following the first drop, called a second drop, sufficiently to alter the deflection of the second drop. In the course of printing, various patterns of large and small drops are created. The size of each drop's wake depends on the drop size. The distance between drops also differs for large drops, small drops, and combinations of the two. As a result of the differences in the wake size and drop spacing, the air flow past a drop depends on the whether it was preceded by a large or small drop. These differences in air flow past a drop include differences in both the perpendicular and parallel components of the relative velocity vectors resulting in variations in drop deflection and in drop flight time to the print media.

The present invention overcomes this problem by directing the drop deflecting gas flow past the drops such that deflection gas flow has a velocity component perpendicular to the drop trajectory sufficient to provide the necessary drop deflection and a velocity component parallel to the drop trajectory that is approximately equal to the drop velocity. A free body diagram of this system is shown in FIG. 3.

Figure 3:
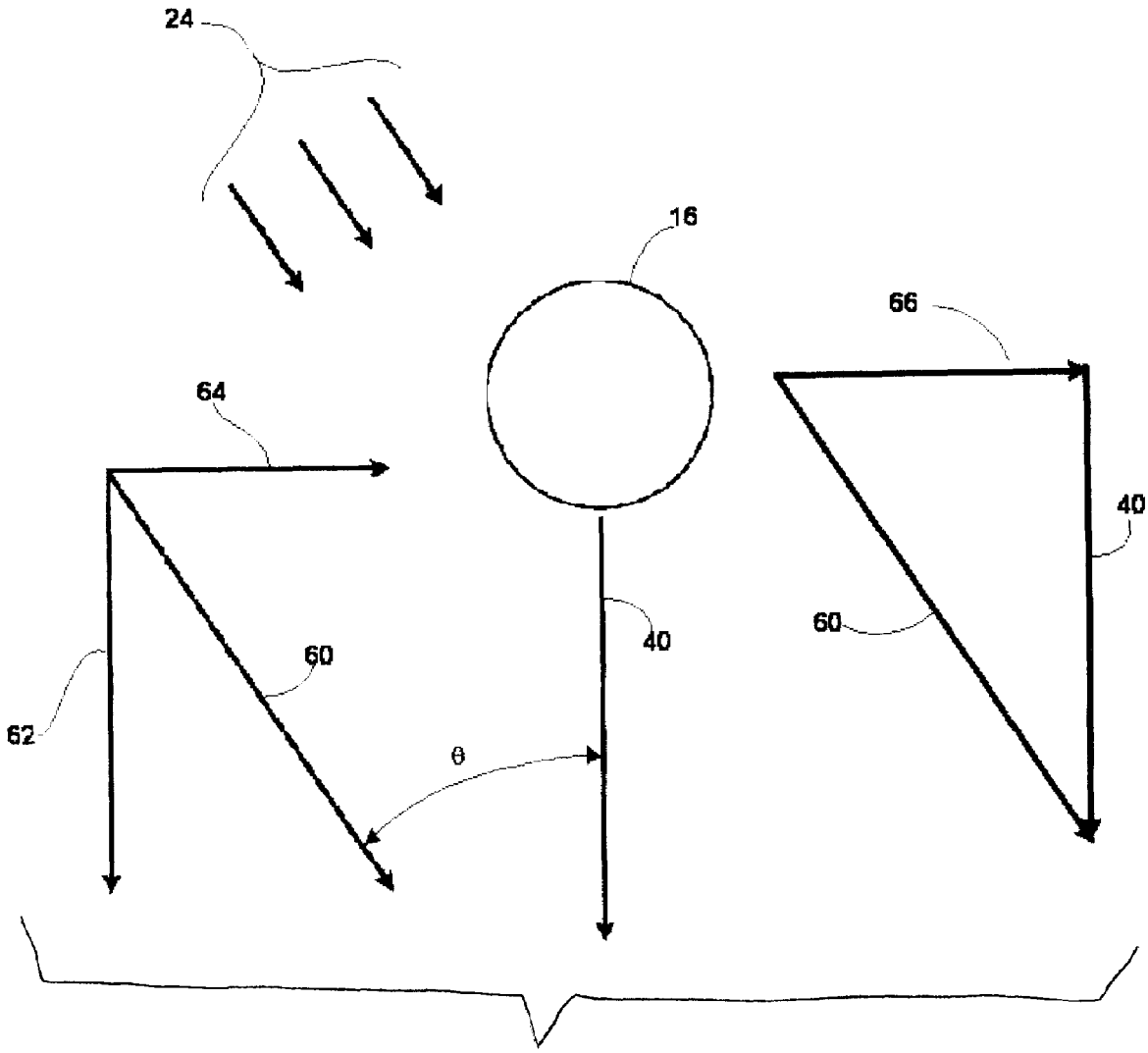
FIG. 3 is a free body diagram of gas flow—drop interaction according to the present invention.

In FIG. 3, the flow of gas 24, for example, air, has a velocity vector 60 having components parallel and perpendicular to the drop velocity vector 40. These components will be referred to as the parallel velocity component 62 and perpendicular velocity component 64. The perpendicular velocity component provides sufficient force to provide the desired change in drop trajectory. The relative velocity vector 66 is the velocity vector 60 minus the drop velocity vector 40. As shown, the relative velocity vector 66 is perpendicular to the drop velocity vector 40. That is, the component of the relative velocity vector parallel to the drop vector is then equal to zero. There is little or no force slowing down the drops as they travel through the drop deflecting gas flow as a result. Furthermore, as the drop wake is aligned with the relative velocity vector, the wake produced in the gas flow is aligned perpendicular to the drop trajectory. As a result, the influence of one drop on the gas flow past a subsequent drop is minimized.

The angle θ between the air velocity vector 60 and the drop velocity vector 40 depends on the ratio of the needed parallel air velocity component and the perpendicular air velocity component. The parallel air velocity component should be approximately equal to the drop velocity and the perpendicular air velocity component should provide sufficient deflection of the drops to discriminate between large and small drop sizes so that one drop size can be used for printing while the other size is caught. If the perpendicular air velocity component is equal to the drop velocity, the downward angle will be about 45°.

While the invention is most effective with the parallel air velocity component 62 is equal to the drop velocity vector 40, it has been found that the invention can also be employed when the parallel air velocity component 62 is not perfectly matched to the drop velocity vector 40. For example, the invention can be effectively employed with a flow of air having a parallel air velocity component greater than or equal to 0.25 times the drop velocity vector, the relative velocity will have component parallel to the drop velocity vector equal to 0.75 times the drop velocity. This small reduction in the parallel air velocity component results in rotating the drop wake sufficiently such that the drop wake has much less influence on the following drop. Although drop deflection having adequate suppression of the drop wake influence on the following drop can be achieved with a low multiplier (greater than or equal to 0.25 times), this result is surprising because it was not initially believed that this result could be achieved with such a small amount of parallel air velocity.

While the invention can be effectively employed with a flow of air having a parallel air velocity component of greater than or equal to 0.25 times the drop velocity, it may be more effectively employed when the parallel air velocity component is greater than 0.5 times the drop velocity vector. This increase in the parallel air velocity component serves to rotate the drop wake farther away from the following drop, so that its influence on the following drop is reduced. Furthermore, the increased parallel air velocity component serves to reduce the air drag that slows the drops as the travel to the print media. However, making the parallel air velocity component greater than 0.75 times the drop velocity vector is even more preferable. And still more preferably is having the parallel air velocity component greater than 0.9 times the drop velocity vector.

As the parallel air velocity component is progressively increased from zero to equaling the drop velocity, the air drag which slows the drops is progressively reduced to zero. The drop wakes are also rotated progressively closer to perpendicular to the drop trajectory reducing their influence on the following drop. Increasing the parallel air velocity component beyond this level causes the component of the relative velocity that is parallel to the drop velocity vector to again increase. In this case, the vertical component of the relative velocity will tend to accelerate the drop toward the print media rather than decelerate it. It will also cause the drop wakes to move away from being perpendicular to the drop trajectory.

If the parallel air velocity component is increased so that it is significantly larger than the drop velocity, a drop wake will begin to influence the preceding drop. For example, if the parallel air velocity component is twice the drop velocity, the component of the relative velocity parallel to the drop trajectory then equals the drop velocity. The magnitude of the component of the relative velocity parallel to the drop trajectory would then equal that produced when the parallel air velocity component was equal to zero. One would therefore anticipate that the magnitude of drop deflection variation would be similar to that encountered with the prior art.

Just as it was found that the invention is effective when the parallel air velocity component is greater than or equals 0.25 times the drop velocity, it appears that the invention is also effective when the parallel air velocity component is less than 1.75 times the drop velocity. The invention appears to be more effective when the parallel air velocity component is less than 1.5 times the drop velocity. The invention appears to be even more effective if the parallel air velocity component is less than 1.25 times the drop velocity, and even more effective when the parallel air velocity component is less than 1.1 times the drop velocity, and most effective when the parallel air velocity component is equal to the drop velocity.

The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Figure 4:
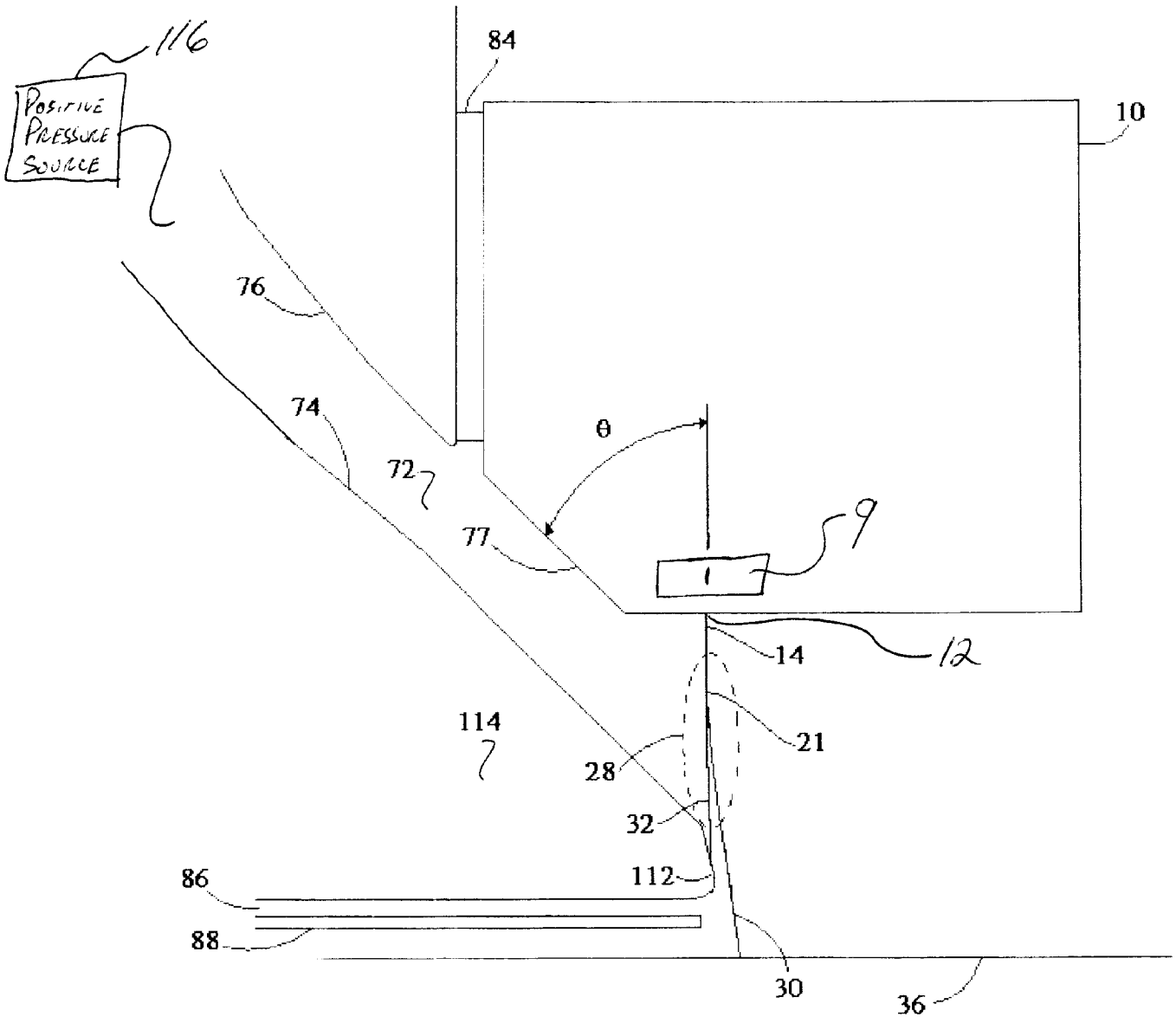
FIG. 4 is a schematic view of a printing apparatus incorporating an example embodiment of the present invention.

FIG. 4 shows an example embodiment of the invention. The printhead 2 has drop generator 10 with at least one nozzle from which ink is emitted under pressure to form filaments of liquid 14. Stimulation device 9, associated with the drop generator 10, is capable of perturbing the filament of liquid to induce portions of the filament to breakoff from the main filament to form drops. In this way, drops are selectively created in the form of large drops and small drops that fly down toward the print media 36. A variety of stimulation devices 9 are know in the art that can be employed for the selective creation of large drops and small drops from the filament of fluid. These include, but are not limited to: piezoelectric actuators, electrohydrodynamic electrode structures, MEMS actuators, charge injection electrodes, lasers, heaters, or combinations thereof.

A first air duct 72, having a lower wall 74 and an upper wall 76, directs air supplied from a positive pressure source 116 at downward angle θ of approximately a 45° toward the drop deflection zone 28. In the deflection zone 28, the flow of air interacts with the drops in the drop stream 21, causing the small drops to follow a small drop trajectory 30 and the large drops to follow a large drop trajectory 30. A catcher 114 has been positioned so that the front face 112 of the catcher intercepts the large drop trajectory. The large drops are caught and the ink returned to the fluid system (not shown) through ink return duct 86, which is formed between the catcher 114 and the plate 88. A Coanda type catcher is shown, but the catcher can be of any suitable design including, but not limited to, Coanda, knife edge, porous face, delimited edge, or combinations thereof.

The small drops following the small drop trajectory 30 are not caught by the catcher, and are allowed to strike the print media. 36. With the air being directed by the first air duct 72 into the deflection zone 28 at a downward angle θ, the flow of air has a parallel air velocity component greater than 0.25 times the drop velocity while the perpendicular air velocity component provides sufficient drop deflection to discriminate between large and small drop trajectories.

The term deflection zone refers to the region around that portion of the drop trajectory wherein the force produced by the airflow provides the bulk of the lateral acceleration on the drops to separate the large and small drops. It should be recognized that the lateral displacement of drops will continue after they leave the deflection as a result of the lateral accelerations applied to the drops in the deflection zone. It should also be recognized that the air flow is not uniform everywhere within the deflection zone. Therefore the parallel air velocity component will not equal a fixed multiplier times the drop velocity everywhere within the deflection zone. Therefore when stating that the parallel air velocity component be greater than 0.25, 0.5, 0.75 or 0.9 times the drop velocity or that the parallel air velocity component be less than 1.75, 1.5, 1.25, or 1.1 times the drop velocity, is not intended to mean that these conditions be met everywhere within the deflection zone. These conditions should be met somewhere within the deflection zone, and preferably be met throughout a majority of the deflection zone.

In the example embodiment shown in FIG. 4, the air duct 72 has a lower wall 74 which comprises a surface of the catcher 114. The upper wall 76 of the air duct is aligned with the beveled face 77 of the drop generator 10. A seal 84 provides an air seal between the upper wall 76 and the drop generator 10. Portions of the air duct walls in this embodiment comprise portions of the catcher 114 and the drop generator 10. It is anticipated that the air duct could comprise air ducts fabricated in the drop generator, the catcher, or as air ducts separated from both of these components.

Figure 5:
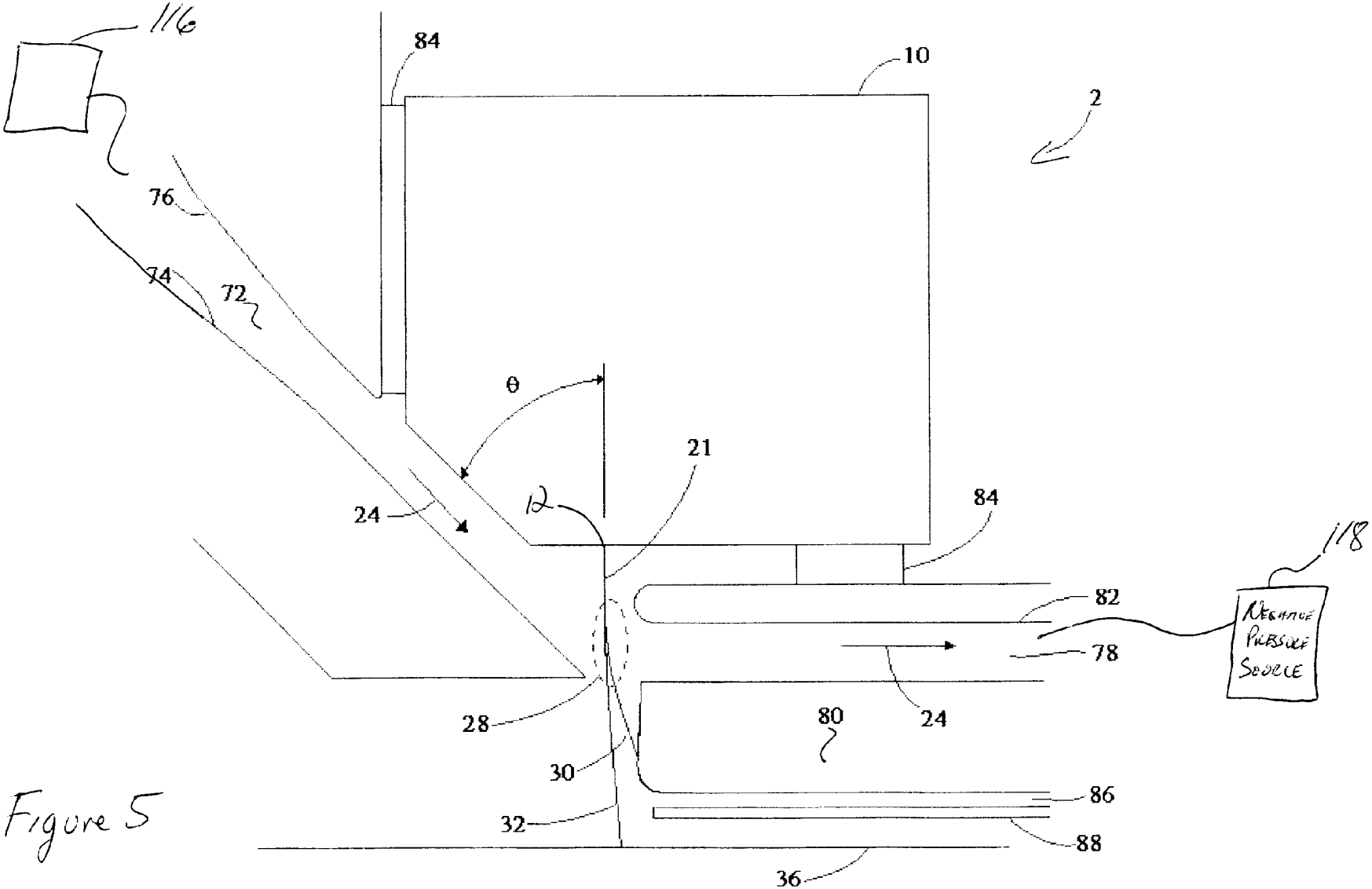
FIG. 5 is a schematic view of a printing apparatus incorporating another example embodiment of the present invention.

FIG. 5 shows another example embodiment of the invention. The printhead 2 has drop generator 10 with at least one nozzle from which ink is emitted under pressure to form filaments of liquid. Stimulation device 9 (shown in FIG. 4) associated with the drop generator is capable of perturbing the filament of liquid to induce portions of the filament to break off from the main filament to form drops. In this way, drops are selectively created in the form of large drops and small drops that fly down toward the print media 36.

A first air duct 72, having a lower wall 74 and an upper wall 76, is located on a first side of the drop streams 21. It directs air supplied from a positive pressure source 116 at downward angle θ of approximately a 45° toward the drop deflection zone 28. A second air duct 78 is located on a second side of the drop streams. It is formed between the catcher 80 and upper wall 82, and exhausts air from the deflection zone 28. Optional seals 84 provide air seals between the drop generator and the upper wall 76 and the upper wall 82. Second duct 78 can be connected to a negative pressure source 118 that is used to help remove air from second duct 78.

Air supplied by the first air duct 72 is directed into the drop deflection zone 28, where it causes the large drops to follow a large drop trajectory and the small drops to follow a small drop trajectory. The small drop trajectory is intercepted by the front face of the catcher 80. The ink then flows down the catcher face and into the ink return duct 86, formed between the catcher 80 and the plate 88, and is returned to the fluid system 35 (shown in FIG. 1). The large drops are not deflected as much as the small drops, missing the catcher 80 and continuing on to the print media 36.

With the air being directed by the first air duct 72 into the deflection zone 28 at a downward angle θ, and exiting the deflection zone 28 via the second air duct 78, the flow of air has a parallel air velocity component greater than 0.25 times the drop velocity while the perpendicular air velocity component provides sufficient drop deflection to discriminate between large and small drop trajectories. That is, it provides sufficient drop deflection so that the small drop trajectory and large drop trajectory diverge so that the catcher can be positioned to intercept one of the trajectories, in this embodiment, the small drop trajectory 30, while not intercepting the other trajectory, in this case the large drop trajectory 32.

Figure 6:
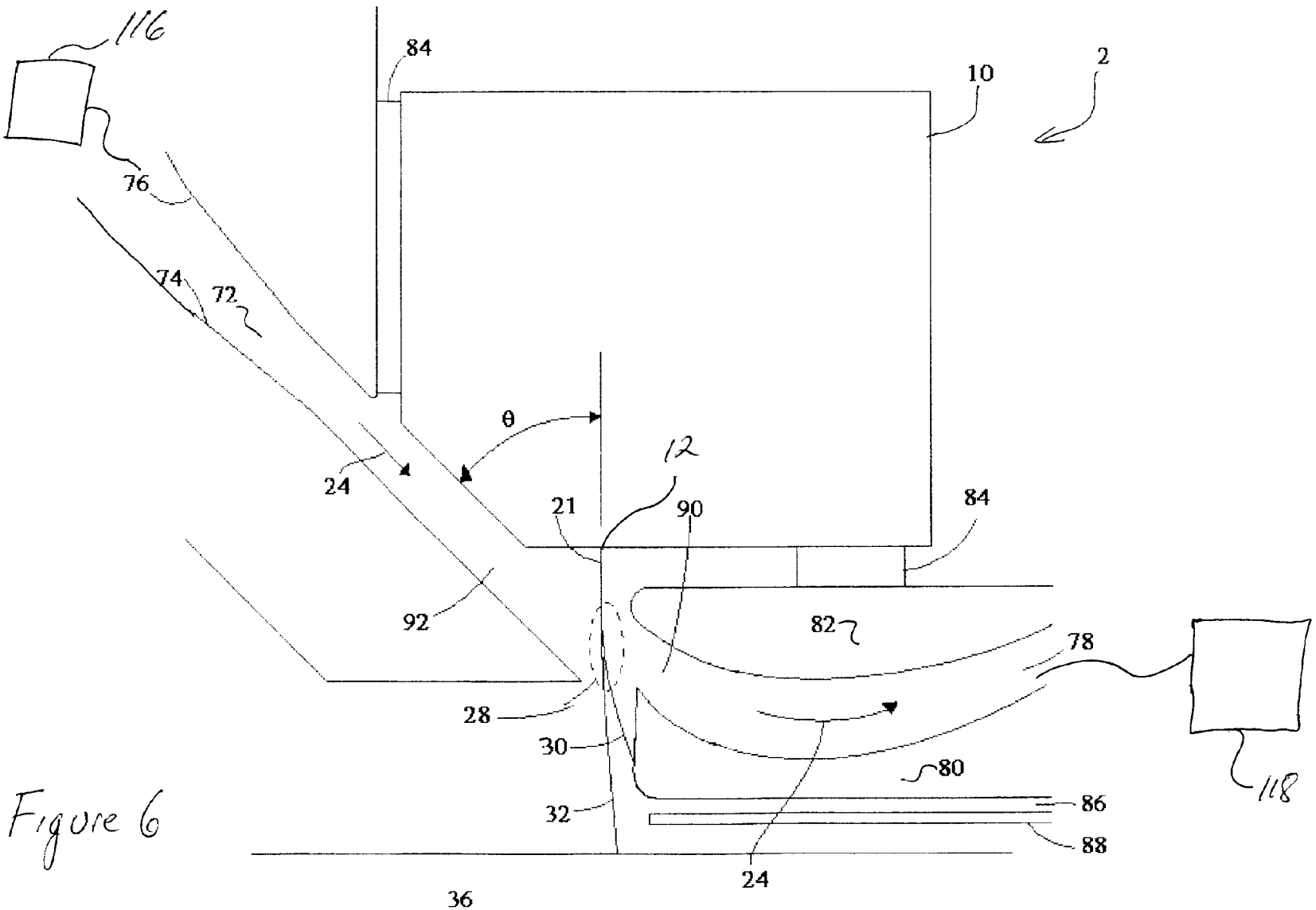
FIG. 6 is a schematic view of a printing apparatus incorporating another example embodiment of the present invention.

FIG. 6 shows another example embodiment of the invention. In this embodiment, the second air duct has been altered so that the air duct entrance portion 90 of the second air duct is aligned with and is approximately parallel to the exit portion 92 of the first air duct 72. In this way the second air duct 78 produces less disruption to the flow of air passing through the deflection zone 28. This embodiment therefore provides a flow of air that has a parallel air velocity component greater than 0.25 times the drop velocity while the perpendicular air velocity component provides sufficient drop deflection to discriminate between large and small drop trajectories. Second duct 78 can be connected to a negative pressure source 118 that is used to help remove air from second duct 78.

Figure 7:
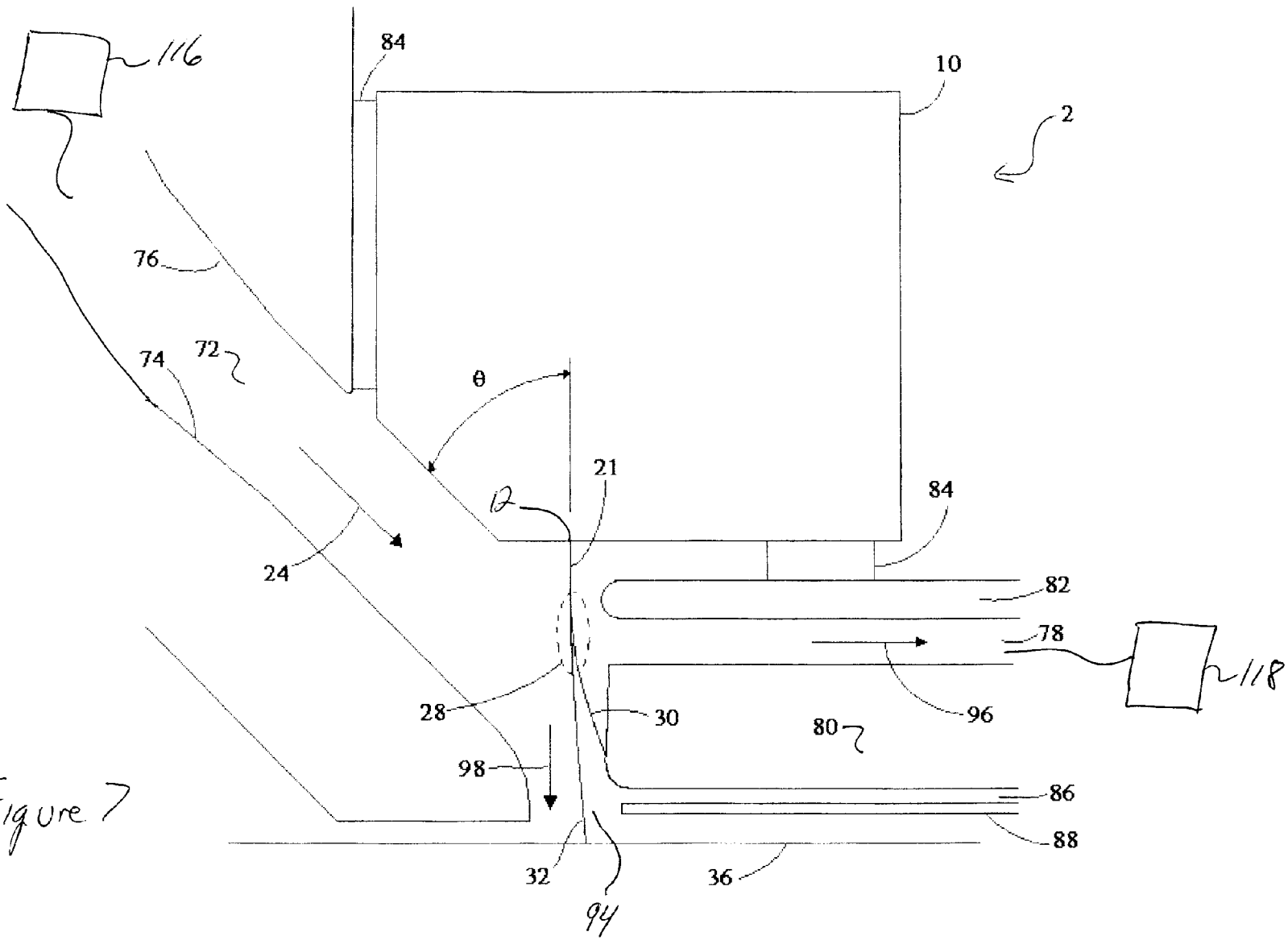
FIG. 7 is a schematic view of a printing apparatus incorporating another example embodiment of the present invention.

FIG. 7 shows another example embodiment of the invention. In this embodiment a first air duct 72 directs a flow of air at a downward angle of θ into the deflection zone 28 as before from which air is extracted by a second air duct 78. The first air duct 72 is much larger that those of the prior embodiments and is able to carry a larger flow of air. The flow of air through the second air duct 78 however is not changed from the previous embodiments. As a result a portion of the flow of air provided by the first air duct 72 passes through the deflection zone 28 and exits by way of the second air duct 78. This first portion 96 of the flow of air has a parallel air velocity component greater than 0.25 times the drop velocity as it passes through the deflection zone while the perpendicular air velocity component provides sufficient drop deflection to discriminate between large and small drop trajectories.

A second portion of the flow of air is directed to be aligned with the drop trajectory below the deflection zone. A structure is positioned relative to the drop trajectory to accomplish this. The portion of the gas flow is aligned with one of the first size drop trajectory and the second size drop trajectory after one of the first size drop trajectory and the second size drop trajectory is beyond the deflection zone. In FIG. 7, the catcher 80 is an example of the structure. Alternatively or additionally, a lower wall 74 can be extended to further define the printhead exit. For example, wall 74 can terminate at substantially the same height as the bottom of catcher 80. In this manner, the gas flow exiting the printhead is aligned with the large volume drop trajectory exiting the printhead.

The catcher 80 is positioned behind or on a second side of the drop trajectory and helps to prevent the flow of air from passing through the drop trajectory and from contributing to the drop deflection. This second portion 98 of the supplied air flow becomes aligned with the drop trajectory below the deflection zone and leaves the enclosed printhead 2 through the printhead exit 94. This second portion of the flow of air, which is approximately parallel to the large print drop trajectory, has the beneficial effect of reducing the air drag on the drops that would slow them down as they travel to the print media. It therefore helps to reduce dot placement errors which might be caused by air drag induced time of flight variations.

Preferably the parallel air velocity component of this second portion air flow is greater than 0.5 times the drop velocity as it passes through the printhead exit. More preferably the second portion of the air flow has a parallel air velocity component of approximately the drop velocity as it passes through the printhead exit. This flow of air out the printhead exit also serves to impede mist, paper dust, or other contaminants from entering the printhead 2.

Figure 8:
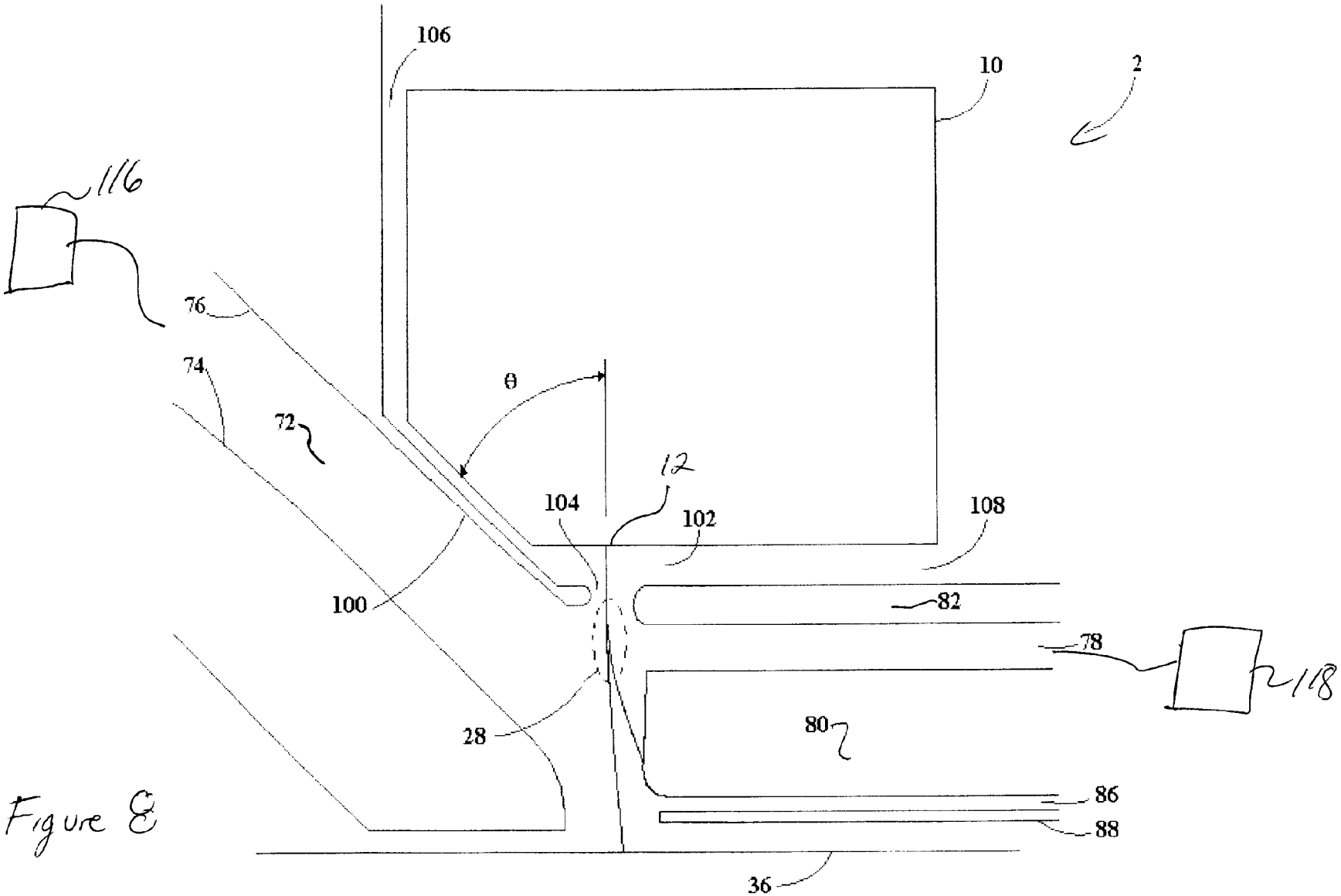
FIG. 8 is a schematic view of a printing apparatus incorporating another example embodiment of the present invention.

FIG. 8 shows another example embodiment of the invention. As in the previous embodiment, the air duct 72 supplies air that is directed toward the drop trajectory. A first portion of this flow of air passes through the deflection zone and exits through the second air duct 78. The downward angle θ of the air duct 72 provides a flow of air that has a parallel air velocity component greater than 0.25 times the drop velocity while the perpendicular air velocity component provides sufficient drop deflection to discriminate between large and small drop trajectories. A second portion of the flow of air aligns with the print drop trajectory below the deflection zone, reducing the air drag on the drops that slows them down as they travel to the print media.

This embodiment also has a barrier 100. An air plenum 102 is formed between the drop generator 10 and the barrier 100 and upper wall 82. A gap 104 is formed between the barrier 100 and the upper wall 82. Drops ejected from the drop generator pass through this gap. Air is supplied to the plenum 102 via at least one of the air ducts 106 and 108. If air is supplied by only one of the air ducts 106 and 108, a seal (not shown) may be used to seal off the other duct. This supplied air exits the plenum 102 through the gap 104. As this second air flow passes through the gap 104, it envelopes the drops and it flows approximately parallel to the drop trajectory as it is directed into the deflection zone. As a result, it reduces the air drag on the drops which might slow them down prior to reaching the deflection zone. The second air flow also contributes to the parallel air velocity component within the deflection zone.

The embodiments described above with reference to FIGS. 5-8 are suitable for use when the printing apparatus is operating in a large drop print mode. That is, each printing apparatus was configured with the catcher 80 positioned to intercept the small drop trajectory 30 while not intercepting the large drop trajectory 32. The large drops that don't strike the catcher then continue on to the print media 36. However, the present invention is also suitable for use when the printing apparatus is operating in a small drop print mode.

Figure 9:
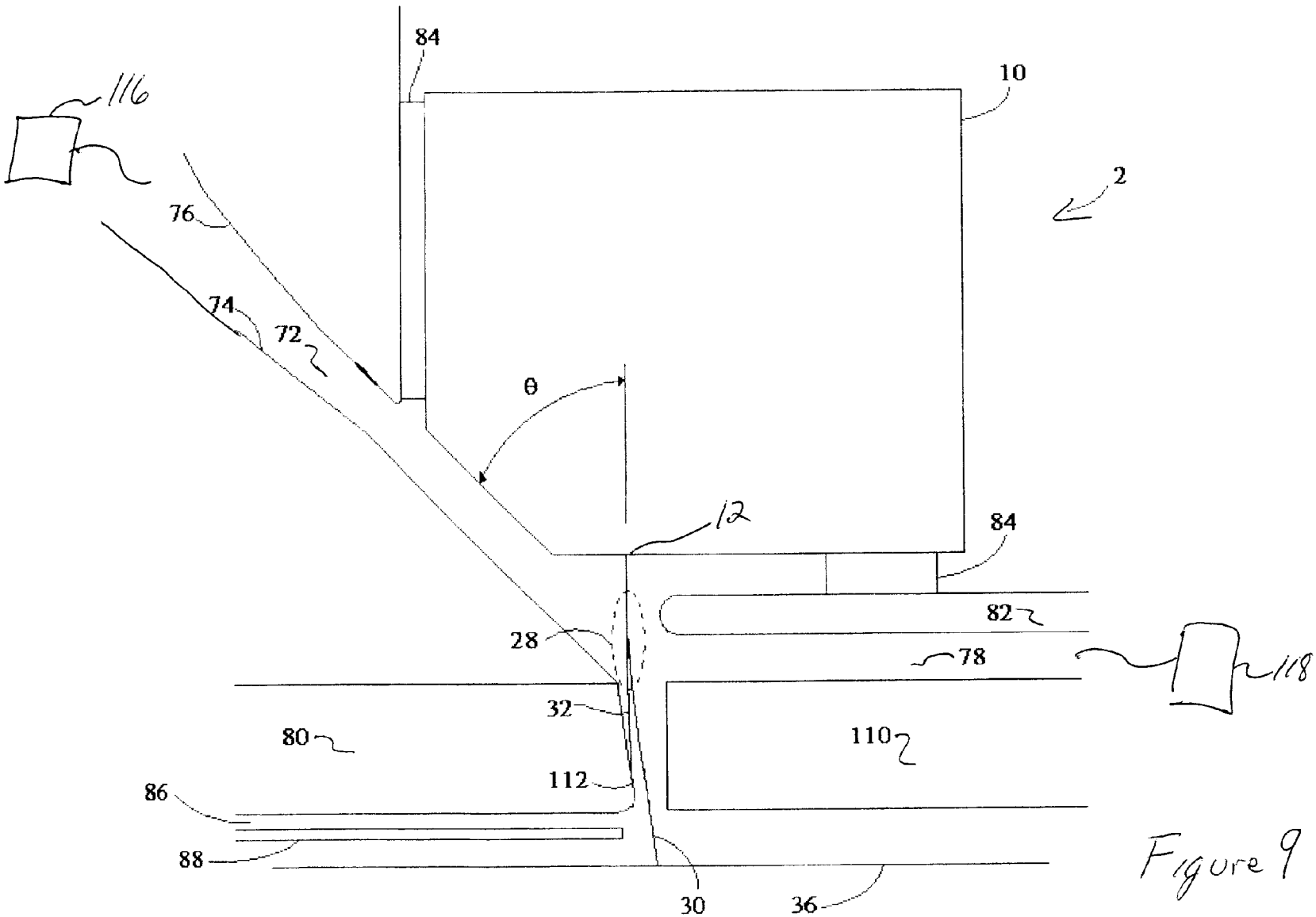
FIG. 9 is a schematic view of a printing apparatus incorporating another example embodiment of the present invention.

FIG. 9 shows another example embodiment of the invention. The embodiment shown in FIG. 9 is similar to the embodiment shown in FIG. 5. Like that embodiment, it has an air duct 72 formed by a lower wall 74 and an upper wall 76. Air is directed by the air duct 72 into the deflection zone 28, from which it exits by way of a second air duct 78.

In the embodiment shown in FIG. 9, the second air duct 78 is formed between an upper wall 82 and a wall 110. In this way, the air duct 72 provides a flow of air that has a parallel air velocity component greater than 0.25 times the drop velocity while the perpendicular air velocity component provides sufficient drop deflection to discriminate between large and small drop trajectories.

Just as the catcher 80 in FIG. 7 served as a structure to cause a portion of the air flow from duct 72 to align with the drop trajectory below the deflection zone and pass out of the printhead exit along with the print drops, the wall 110 in FIG. 9 can serve as a such a structure to produce the same result here.

A catcher 80 is placed beneath the lower wall 74 on the same side of the drop trajectories as the air duct 72. The front face 112 of the catcher 80 has been positioned to intercept the large drop trajectory 32 but not the small drop trajectory 30. The small drops therefore pass by the catcher 80 and continue on the print media 36. The ink that strikes the front face 112 flows down the front face and enters the ink return duct 86 formed between the catcher 80 and the plate 88. While FIG. 9 shows the catcher 80 and the lower wall 74 as two components, it is anticipated that they could formed as a single component.

Figure 10:
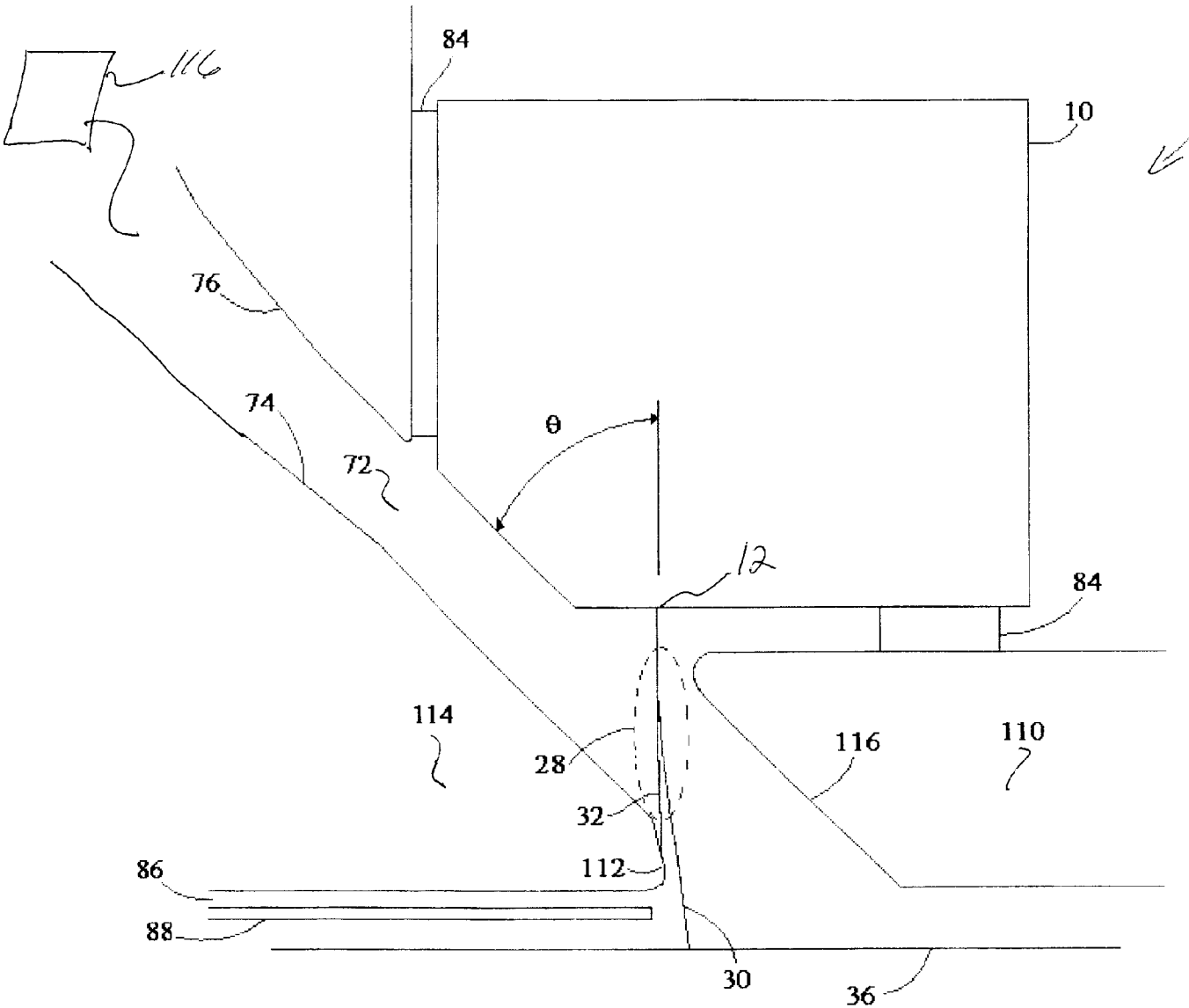
FIG. 10 is a schematic view of a printing apparatus incorporating another example embodiment of the present invention.

FIG. 10 shows another embodiment suitable for use when the printing apparatus is operating in a small drop print mode. In this embodiment, the lower wall 74 is constructed as a portion of the catcher 114 on the first side of the drop streams. Like previous embodiments, it has an air duct 72 formed by a lower wall 74 and an upper wall 76. Air is directed with a downward angle θ by the air duct 72 into the deflection zone 28.

In this embodiment, the front face 116 of a second structure, for example, wall 110, on the second side of the drop trajectory is approximately parallel to the lower wall 74 and has been positioned to be aligned approximately with the upper wall 76 of the air duct 72. In this way it serves to extend the air duct 72 through the drop deflection zone to the second side of the drop streams. The air duct 72 provides a flow of air that has a parallel air velocity component greater than 0.25 times the drop velocity while the perpendicular air velocity component provides sufficient drop deflection to discriminate between large and small drop trajectories. The front face 112 of the catcher 114 has been positioned to intercept the large drop trajectory 32 but not the small drop trajectory 34. The small drops therefore pass by the catcher and continue on the print media 36. The ink that strikes the front face 112 flows down the front face and enters the ink return duct 86 formed between the catcher 80 and the plate 88. While FIGS. 9 and 10 show wall 110 with face 116 either approximately parallel to the direction of the liquid filament 14 (in FIG. 9) or parallel to air duct 72 (in FIG. 10), it should be understood that other intermediate angles are also permitted.

In each of the embodiments shown, the air duct 72 has a downward angle θ of approximately 45°. Such an angle is appropriate for a system in which the perpendicular air velocity component needed to provides sufficient drop deflection to discriminate between large and small drop trajectories is approximately equal to the parallel air velocity component, where the parallel air velocity component is greater than 0.25 times the drop velocity vector.

Different system requirements may result in changes in the perpendicular air velocity component needed to discriminate between large and small drop trajectories. For example, the perpendicular air velocity component required to discriminate between large and small drop trajectories is known to depend on nozzle size; larger nozzle diameters sizes require a larger perpendicular air velocity component to discriminate between large and small drop trajectories than do smaller nozzle diameters. As a result of such differences in system requirements, the downward angle of the air duct 72 may deviate from the approximately 45° angle shown in these embodiments.

In the description above, reference has been made to downward angle. As used herein, the term "down" corresponds to the direction toward which drops are emitted from the drop generator. In this sense, the term "down" does not necessarily refer to a direction of drop travel that corresponds to the force of gravity. As such, drops can be emitted from the drop generator in an upward direction or another direction depending on the orientation of the drop generator.

The term "air" is intended to include air, but can also include any suitable gaseous fluid. Additionally, the air that is provided to the deflection zone can be filtered or cleaned prior to delivery to the deflection zone to help maintain a clean printhead environment. When done, filtering is accomplished using conventional techniques, for example, using one or more HEPA filters positioned between the source of the air flow and the deflection zone.

The drops are typically drops of liquid inks, but can include other liquid mixtures desirable for selective application to a receiver. Typically, receivers include a print media when the drops are ink. However, when the drops are other types of liquid, the receiver can be other structures, for example, circuit board material, stereo-lithographic substrates, medical delivery devices, etc.

The invention has been described in detail with particular reference to certain example embodiments thereof, but it will be understood that variations and modifications can be effected within the scope of the invention.

PARTS LIST

| | |
|---|---|
| Printhead | 2 |
| Drop Stimulation/Forming Device | 9 |
| Drop Generator | 10 |
| Nozzle | 12 |

-continued

| | |
|---|---|
| Filament Of Fluid | 14 |
| Drops | 16 |
| Large Drop | 18 |
| Small Drop | 20 |
| Drop Stream | 21 |
| Duct | 22 |
| Flow Of Air | 24 |
| Drop Trajectory | 26 |
| Deflection Zone | 28 |
| Small Drop Trajectory | 30 |
| Large Drop Trajectory | 32 |
| Catcher | 34 |
| Fluid System | 35 |
| Print Media | 36 |
| Dot | 38 |
| Drop Velocity Vector | 40 |
| Air Velocity Vector | 44 |
| Relative Velocity Vector | 46 |
| Air Speed Contours | 47 |
| First Drop | 48 |
| Second Drop | 49 |
| Drop Wake | 50 |
| Air Velocity Vector | 60 |
| Perpendicular Air Velocity Component | 62 |
| Parallel Air Velocity Component | 64 |
| First Air Duct | 72 |
| Lower Wall | 74 |
| Upper Wall | 76 |
| Second Air Duct | 78 |
| Catcher | 80 |
| Upper Wall | 82 |
| Seal | 84 |
| Ink Return Duct | 86 |
| Plate | 88 |
| Entrance Portion | 90 |
| Exit Portion | 92 |
| Printhead Exit | 94 |
| First Portion Of Air Flow | 96 |
| Second Portion Of Air Flow | 98 |
| Barrier | 100 |
| Plenum | 102 |
| Gap | 104 |
| Air duct | 106 |
| Air duct | 108 |
| Wall | 110 |
| Front Face | 112 |
| Catcher | 114 |
| Positive Pressure Source | 116 |
| Negative Pressure Source | 118 |

The invention claimed is:

1. A printing apparatus comprising:

a drop generator operable to selectively form a drop having a first size and a drop having a second size from liquid emitted through a nozzle associated with the drop generator, the drop having the first size and the drop having the second size traveling along a drop trajectory, the first size being larger than the second size when compared to each other, each of the drops having a drop velocity;

a gas flow deflection system including a gas flow directed at a deflection zone that comprises at least a portion of the drop trajectory, the gas flow in the deflection zone including a velocity vector having a parallel velocity component and a perpendicular velocity component, the parallel velocity component and the perpendicular velocity component being defined relative to the drop trajectory, the parallel velocity component being greater than 0.25 times the drop velocity, and the perpendicular velocity component being sufficient to deflect the drop having the first size and the drop having the second size to a first size drop trajectory and a second size drop trajectory; and a catcher positioned relative to one of the first drop size trajectory and the second drop size trajectory such that the drops traveling along one of the first drop size trajectory and the second drop size trajectory are intercepted by the catcher while drops traveling along the other of the first drop size trajectory and the second drop size trajectory are not intercepted by the catcher.

2. The apparatus of claim 1, wherein the wherein the parallel velocity component is greater than 0.5 times the drop velocity.

3. The apparatus of claim 1, wherein the wherein the parallel velocity component is greater than 0.75 times the drop velocity.

4. The apparatus of claim 1, wherein the wherein the parallel velocity component is greater than 0.9 times the drop velocity.

5. The apparatus of claim 1, wherein the gas flow deflection system includes a duct positioned at an angle relative to the drop trajectory such that the gas flow is directed to the deflection zone at an angle relative to the drop trajectory, wherein the angle of the duct relative to the drop trajectory is related to a ratio of the parallel velocity component to the perpendicular velocity component.

6. The apparatus of claim 5, the duct being a first duct and being positioned relative to a first side of the drop trajectory, the apparatus further comprising:

a second duct positioned on a second side of the drop trajectory, the second duct being an exit for the gas flow passing through the deflection zone.

7. The apparatus of claim 6, further comprising a structure positioned relative to the drop trajectory such that a portion of the gas flow is approximately aligned with one of the first size drop trajectory and the second size drop trajectory after one of the first size drop trajectory and the second size drop trajectory is beyond the deflection zone.

8. The apparatus of claim 7, wherein the structure is a catcher positioned on the second side of the drop trajectory.

9. The apparatus of claim 7, wherein the aligned portion of the gas flow has a velocity component that is greater than 0.5 times the drop velocity.

10. The apparatus of claim 1, wherein the parallel velocity component is less than 1.75 times the drop velocity.

11. The apparatus of claim 1, wherein the parallel velocity component is less than 1.1 times the drop velocity.

12. The apparatus of claim 1, the gas flow deflection system including a gas source, wherein a filter is located between the gas source and the deflection zone.

13. The apparatus of claim 5, further comprising:

a plenum structure positioned to direct a second gas flow toward the deflection zone, the second gas flow being approximately parallel to the drop trajectory.

14. The apparatus of claim 5, wherein the catcher is positioned relative to the drop trajectory on the same side as that of the duct of the gas flow deflection system such that the drops having the first size are intercepted by the catcher.

15. The apparatus of claim 5, wherein the catcher is positioned relative to the drop trajectory on an opposite side as that of the duct of the gas flow deflection system such that the drops having the second size are intercepted by the catcher.

16. The apparatus of claim 5, the duct including a wall positioned on a first side relative to the drop trajectory, the duct including a second structure positioned on a second side relative to the drop trajectory, the second structure including a front face, wherein the front face of the structure is approximately parallel to the wall of the duct.

17. The apparatus of claim 5, wherein the drop generator comprises a portion of the duct.

18. The apparatus of claim 6, the first duct including an exit portion, the second duct including an entrance portion, wherein the entrance portion of the second duct is positioned parallel to an exit portion of the first duct.

19. A method of printing comprising:

selectively forming a drop having a first size and a drop having a second size from liquid emitted through a nozzle associated with a drop generator, the drop having the first size and the drop having the second size traveling along a drop trajectory, the first size being larger than the second size when compared to each other, each of the drops having a drop velocity;

directing a gas flow toward a deflection zone that comprises at least a portion of the drop trajectory using a gas flow deflection system, the gas flow in the deflection zone including a velocity vector having a parallel velocity component and a perpendicular velocity component, the parallel velocity component and the perpendicular velocity component being defined relative to the drop trajectory, the parallel velocity component being greater than 0.25 times the drop velocity, and the perpendicular velocity component being sufficient to deflect the drop having the first size and the drop having the second size to a first size drop trajectory and a second size drop trajectory; and intercepting the drops traveling along one of the first drop size trajectory and the second drop size trajectory using a catcher positioned relative to one of the first drop size trajectory and the second drop size trajectory while not intercepting drops traveling along the other of the first drop size trajectory and the second drop size trajectory.

20. A printhead comprising:

a drop generator configured to selectively form a large volume drop and a small volume drop from liquid emitted through a nozzle associated with the drop generator, the large volume drop and the small volume drop traveling along an initial drop trajectory;

a gas flow deflection system including a gas flow provided by a positive pressure source through a first gas flow duct, the gas flow being directed at a non-perpendicular non-parallel angle relative to the initial drop trajectory such that the small volume drop is deflected from the initial drop trajectory by the gas flow and begins traveling along a deflected small volume drop trajectory; and a catcher positioned relative to the deflected small volume drop trajectory such that the small volume drop is intercepted by the catcher, a portion of the gas flow provided by the first gas flow duct being removed from the printhead through a second gas flow duct located between the catcher and the drop generator.

21. The printhead of claim 20, further comprising:

a negative pressure source coupled to the second gas flow duct.

22. The printhead of claim 21, further comprising a structure positioned relative to the first gas flow duct such that a second portion of the gas flow provided by the first gas flow duct is aligned with a large volume drop trajectory as the second portion of the gas flow exits the printhead.

23. The printhead of claim 20, wherein the catcher is a Coanda type catcher.

24. A method of printing comprising:

selectively forming a large volume drop and a small volume drop from liquid emitted through a nozzle using a drop generator, the large volume drop and the small volume drop traveling along an initial drop trajectory;

providing a gas flow created by a positive pressure source through a first gas flow duct of a gas flow deflection system;

directing the gas flow at a non-perpendicular non-parallel angle relative to the initial drop trajectory to deflect the small volume drop from the initial drop trajectory to a deflected small volume drop trajectory;

intercepting the small volume drop using a catcher positioned relative to the deflected small volume drop trajectory; and removing a portion of the gas flow provided by the first gas flow duct from the printhead through a second gas flow duct located between the catcher and the drop generator.

25. A printhead comprising:

a drop generator configured to selectively form a large volume drop and a small volume drop from liquid emitted through a nozzle associated with the drop generator, the large volume drop and the small volume drop traveling along an initial drop trajectory;

a gas flow deflection system including a gas flow provided by a positive pressure source through a first gas flow duct, the gas flow being directed at a non-perpendicular non-parallel angle relative to the initial drop trajectory such that the small volume drop is deflected from the initial drop trajectory by the gas flow and begins traveling along a deflected small volume drop trajectory; and a catcher positioned relative to the initial drop trajectory such that the large volume drop is intercepted by the catcher, the first gas flow duct being located between the catcher and the drop generator.

26. The printhead of claim 25, further comprising:

a second gas flow duct located relative to the initial drop trajectory on a side opposite that of the first gas flow duct, wherein a portion of the gas flow provided by the first gas flow duct is removed from the printhead through the second gas flow duct.

27. The printhead of claim 26, further comprising:

a negative pressure source coupled to the second gas flow duct.

28. The printhead of claim 25, the catcher including a face positioned relative to the initial drop trajectory such that the large volume drop is intercepted by the face of the catcher, wherein the face of the catcher is positioned at an angle relative to the initial drop trajectory.

29. The printhead of claim 25, wherein the catcher is a Coanda type catcher.

30. A method of printing comprising:

selectively forming a large volume drop and a small volume drop from liquid emitted through a nozzle using a drop generator, the large volume drop and the small volume drop traveling along an initial drop trajectory;

providing a gas flow created by a positive pressure source through a first gas flow duct of a gas flow deflection system;

directing the gas flow at a non-perpendicular non-parallel angle relative to the initial drop trajectory to deflect the small volume drop from the initial drop trajectory to a deflected small volume drop trajectory; and intercepting the large volume drop using a catcher positioned relative to the initial drop trajectory, the first gas flow duct being located between the catcher and the drop generator.

* * * * *